US006209139B1

(12) United States Patent
Schmidt et al.

(10) Patent No.: US 6,209,139 B1
(45) Date of Patent: Apr. 3, 2001

(54) NOVELTY CAPS HAVING OPENABLE AREAS

(76) Inventors: Andrew Schmidt, 2400 Kestel La.; Larry Calderon, Sr., W269 S3690 Merrill Hills Rd., both of Waukesha, WI (US) 53189

( * ) Notice: Subject to any disclaimer, the term of this patent is extended or adjusted under 35 U.S.C. 154(b) by 0 days.

(21) Appl. No.: 09/547,311

(22) Filed: Apr. 11, 2000

(51) Int. Cl.[7] ..... A42B 1/00
(52) U.S. Cl. ..... 2/171.1; 2/209.13
(58) Field of Search ..... 2/171.1, 209.13, 2/425, 10, 209.12, 175.1, 195.1

(56) References Cited

U.S. PATENT DOCUMENTS

| | | | | |
|---|---|---|---|---|
| 33,121 | * | 8/1861 | Blythe | 2/10 |
| 1,210,119 | * | 12/1916 | Weber | 2/424 |
| 4,985,935 | * | 1/1991 | Hur | 2/209.1 |
| 5,054,123 | * | 10/1991 | Helms | 2/12 |
| 5,517,698 | * | 5/1996 | Nault et al. | 2/424 |
| 5,685,017 | * | 11/1997 | Kraft | 2/171.1 |
| 5,862,520 | * | 1/1999 | Wyant | 2/10 |

* cited by examiner

*Primary Examiner*—Bibhu Mohanty
(74) *Attorney, Agent, or Firm*—Donald J. Ersler

(57) ABSTRACT

According to the present invention, a novelty cap with an open area includes a cap base, a first pivot cover, a second pivot cover, and a release latch. The first pivot cover is preferably pivotally attached to a front and rear of the cap base. The second pivot cover is pivotally attached to the front and rear of the cap base, adjacent the first pivot cover. The release latch is preferably mounted to one of the pivot covers. Pressing down on the release latch allows both pivot covers to pivot downward and reveal an opening in the top of the novelty cap with an open area. A novelty cap with openable areas includes a cap body, a first detachable flap, and a second detachable flap. Two openings are formed in a top of the cap body. One end of the first detachable flap is attached to a bottom side of a first opening and one end of the second detachable flap is attached to a bottom side of a second opening. The other end of the first detachable flap is releasably attached to a top side of the first opening and the other end of the second detachable flap is releasably attached to a top side of the second opening.

5 Claims, 5 Drawing Sheets

NOVELTY CAPS HAVING OPENABLE AREAS

BACKGROUND OF THE INVENTION

1. Field of the Invention

The present invention relates generally to novelty caps and more specifically to novelty caps having areas which may be opened or detached to mimic an open, retractable roof stadium.

2. Discussion of the Prior Art

Currently, it appears that novelty caps which have areas that open-up to mimic an open, retractable roof stadium do not exist. Novelty hats with openable areas would probably be of interest to sports fans who buy novelty sports items to show their enthusiasm for a particular sports team.

Accordingly, there is a clearly felt need in the art for novelty hats with areas that open-up to mimic retractable roof stadiums.

SUMMARY OF THE INVENTION

The present invention provides a novelty cap with areas which may be detached or opened. According to the present invention, a novelty cap with an open area includes a cap base, a first pivot cover, a second pivot cover, and a release latch. The first pivot cover is preferably pivotally attached to a front and rear of the cap base. The second pivot cover is pivotally attached to the front and rear of the cap base, adjacent the first pivot cover. The release latch is preferably mounted to one of the pivot covers. Pressing down on the release latch allows both pivot covers to pivot downward and reveal an opening in the top of the novelty cap with an openable area. A pop-up sign may also be attached to an inside front of the cap base.

A novelty cap with openable areas includes a cap body, a first detachable flap, and a second detachable flap. Two openings are preferably formed in a top of the cap body. One end of the first detachable flap is attached to a bottom side of a first opening and one end of the second detachable flap is attached to a bottom side of a second opening. The other end of the first detachable flap is releasably attached to a top side of the first opening and the other end of the second detachable flap is releasably attached to a top side of the second opening.

Accordingly, it is an object of the present invention to provide a novelty cap with openable areas which may mimic a retractable roof stadium which has been opened.

These and additional objects, advantages, features and benefits of the present invention will become apparent from the following specification.

DETAILED DESCRIPTION OF THE PREFERRED EMBODIMENTS

Figure 1:
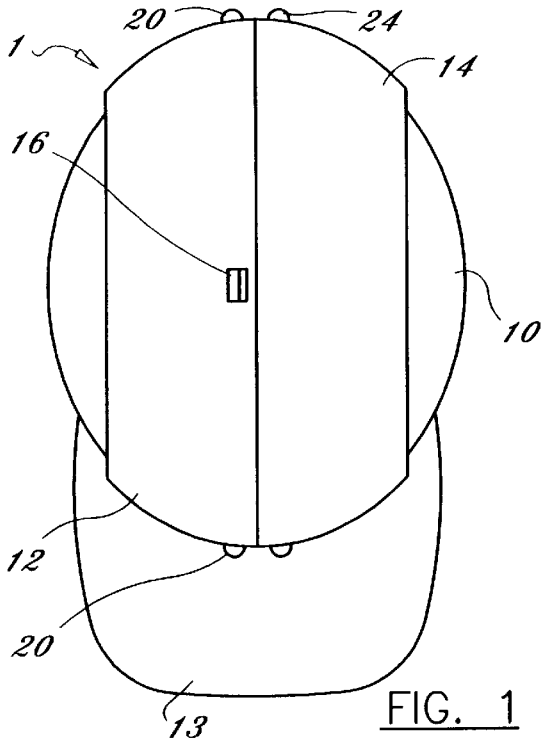
FIG. 1 is a top view of a novelty cap with an openable area with the pivot halves in a closed position in accordance with the present invention.
Figure 6:
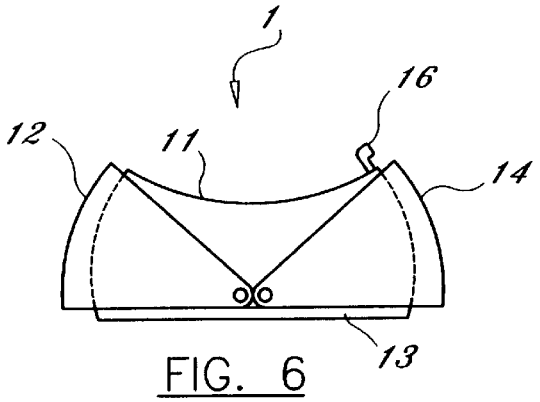
FIG. 6 is an end view of a novelty cap with an openable area with the pivot halves in a retracted position in accordance with the present invention.

With reference now to the drawings, and particularly to FIG. 1, there is shown a top view of a novelty cap having an openable area 1. With reference to FIGS. 1*a*–3, the novelty cap having an openable area 1 includes a cap base 10, a first pivot cover 12, a second pivot cover 14, and a release latch 16. The cap base 10 includes a peripheral side wall 11 and preferably a visor 13. The visor 13 extends outward from a bottom edge of the peripheral side wall 11. A height of the peripheral side wall 11 is preferably curved to allow the first and second pivot covers to pivot over thereof as shown in FIG. 6. The peripheral side wall 11 has particular height which provides a light opening 18. The first pivot cover 12 is preferably pivotally attached to a front and rear of the cap base 10 with a pair of rivets 20. The second pivot cover 14 is preferably pivotally attached to the front and rear of the cap base 10, adjacent the first pivot cover 12 with a pair of rivets 24. Other devices or pivoting methods may be used besides the rivets 20 and 24.

Figure 1A:
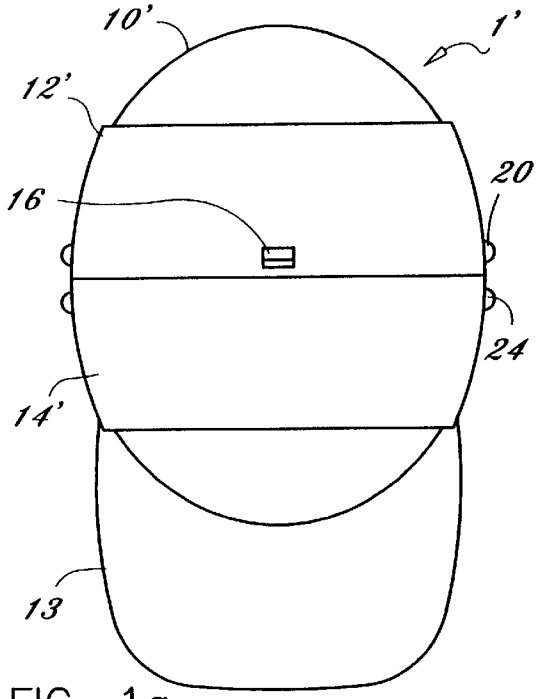
FIG. 1*a* is a top view of a novelty cap with an openable area with the pivot halves rotated substantially perpendicular to those disclosed in FIG. 1, in accordance with the present invention.
Figure 1B:
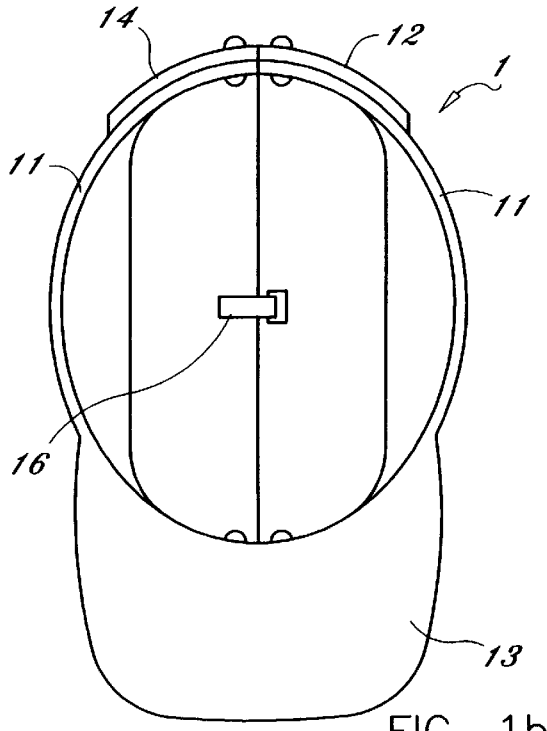
FIG. 1*b* is a bottom view of a novelty cap with an openable area with the pivot halves in a closed position in accordance with the present invention.
Figure 2:
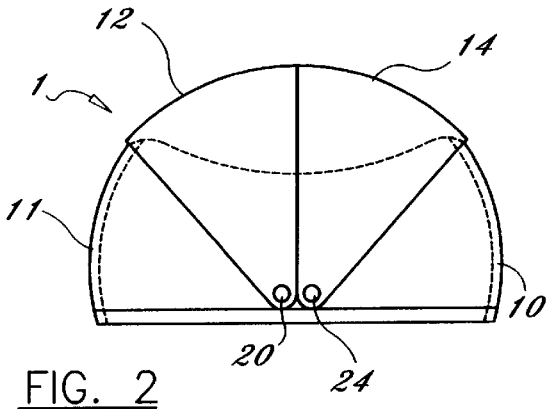
FIG. 2 is an end view of a novelty cap with an openable area with the pivot halves in a closed position in accordance with the present invention.
Figure 3:
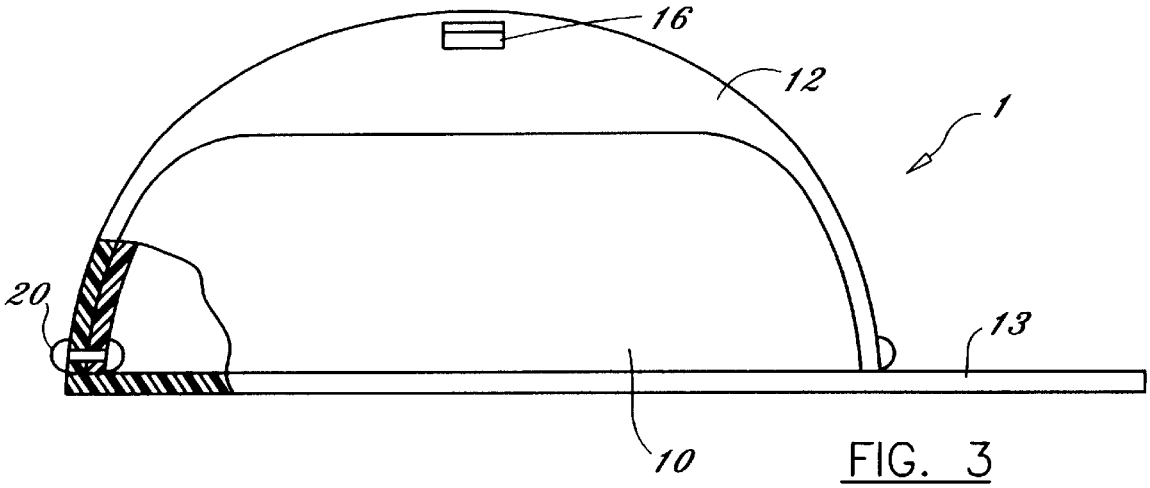
FIG. 3 is a side view of a novelty cap with an openable area with the pivot halves in a closed position in accordance with the present invention.

With reference to FIG. 1*a*, a novelty cap having an openable area 1' includes a cap base 10', a first pivot cover 12', a second pivot cover 14', and a release latch 16. The pivot halves have been rotated substantially perpendicular to those disclosed in FIG. 1. The construction of the novelty cap having an openable area 1' is the same as the novelty cap having an openable area 1. The only difference between the novelty cap 1 and the novelty cap 1' is the orientation of the pivoting halves relative to the wearer's forehead. The novelty cap having an openable area 1 or 1' should not be limited to orientating the pivoting halves relative to the wearer's forehead at only two different angles (as shown in FIGS. 1 & 1*a*, but should include any angle.

Figure 4A:
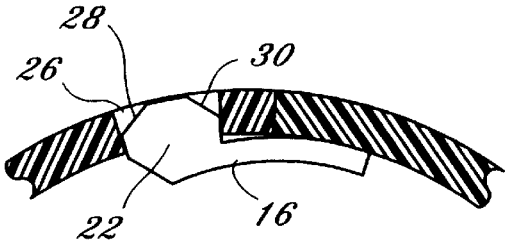
FIG. 4*a* is an enlarged perspective view of the release latch of a novelty cap with an openable area with the latch in a locked position in accordance with the present invention.
Figure 4B:
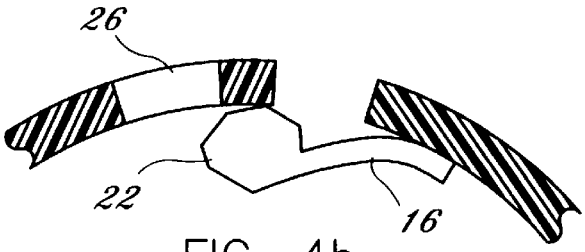
FIG. 4*b* is an enlarged perspective view of the release latch of a novelty cap with an openable area with latch in an unlocked in accordance with the present invention.
Figure 5:
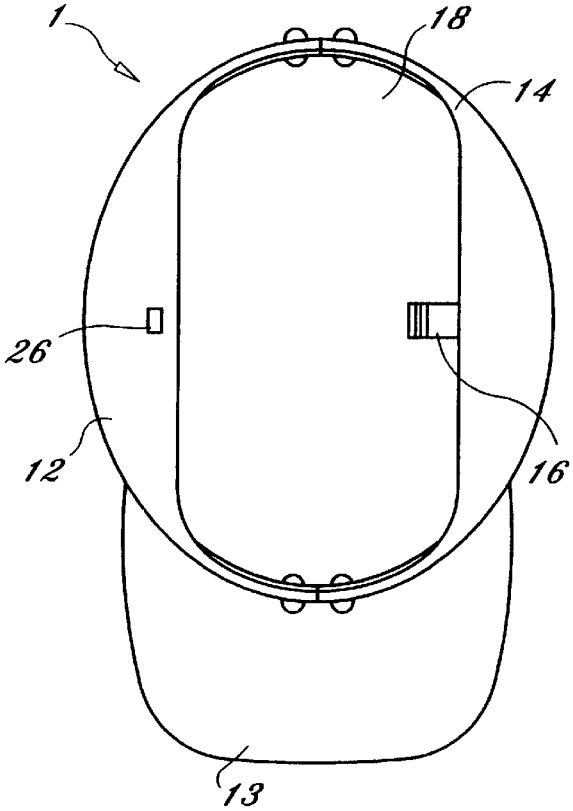
FIG. 5 is a top view of a novelty cap with an openable area with the pivot halves in a retracted position in accordance with the present invention.

With reference to FIGS. 4*a* and 4*b*, the release latch 16 is preferably mounted to one of the pivot covers. A catch 22 of the release latch 16 is pushed downward to release thereof from a latch slot 26 formed in the other pivot cover. A front chamfer 28 is preferably formed in a front of the catch 22 and a rear chamfer 30 is preferably formed in a rear of the catch 22. The chamfers facilitate a smooth release and reattachment of the first and second pivot covers. The release of the first and second pivot covers reveal the light opening 18 in a top of the novelty cap 1.

Figure 7:
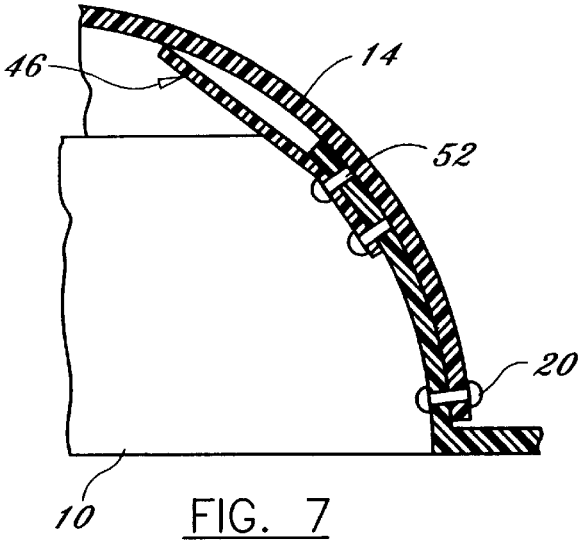
FIG. 7 is an enlarged cross-sectional view of a front of a novelty cap with an openable area with a pop-up sign contained therein in accordance with the present invention.
Figure 8:
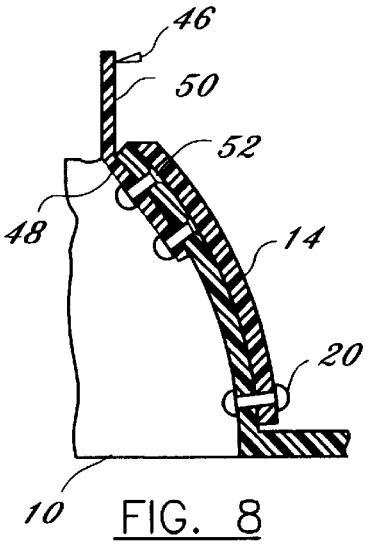
FIG. 8 is an enlarged cross-sectional view of a front of a novelty cap with an openable area in a retracted position with a pop-up sign in an upright position in accordance with the present invention.
Figure 9:
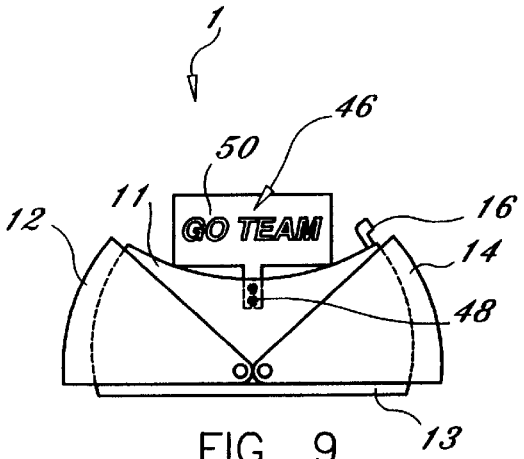
FIG. 9 is a front view of a novelty cap with an openable area with the pivot halves in a retracted position with a pop-up sign in an upright position in accordance with the present invention.
Figure 14:
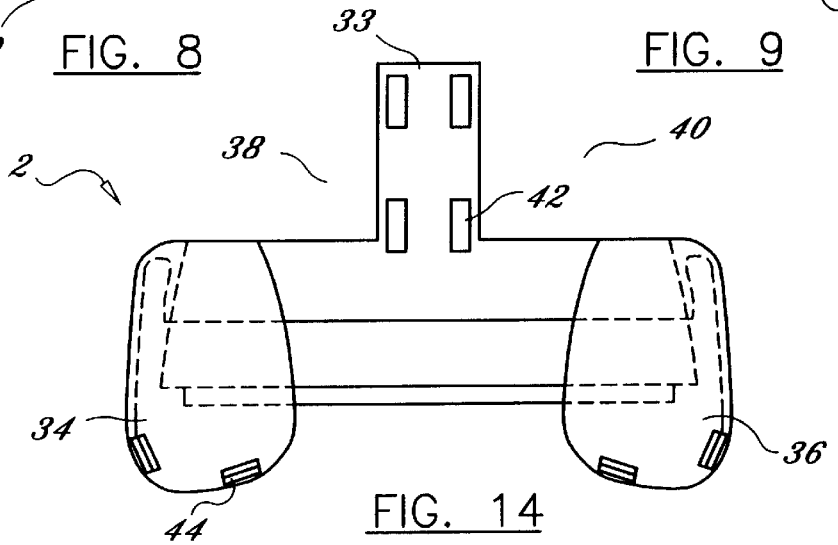
FIG. 14 is an end view of a novelty cap with openable areas having detachable flaps in a retracted position in accordance with the present invention.

With reference to FIGS. 7–9, a pop-up sign 46 is attached to a front of the cap base 10. The pop-up sign 46 includes an angled stem 48 and a sign portion 50. The angled stem 48 is preferably attached to an inside front of the cap base 10 with rivets 52, sonic welding, or with any other suitable method. The pop-up sign 46 is shown in its normal position in FIG. 8. The pop-up sign 46 may be bent downward to fit under the first and second pivot covers as shown in FIG. 7. FIG. 9 shows a front view of the sign portion 50 in its normal position. The pop-up sign 46 must be fabricated from a material having memory such as delrin plastic, spring steel, or any other material with memory. A material having "memory" is defined as a material which returns to its original position after being bent or deformed.

Figure 10:
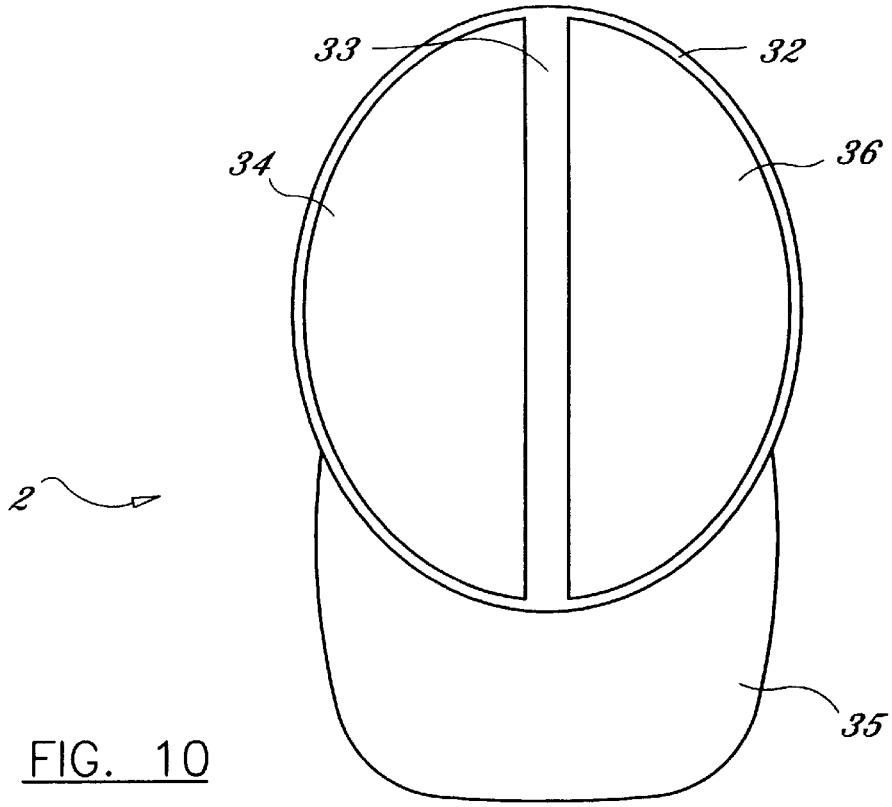
FIG. 10 is a top view of a novelty cap with openable areas having detachable flaps in a closed position in accordance with the present invention.
Figure 11:
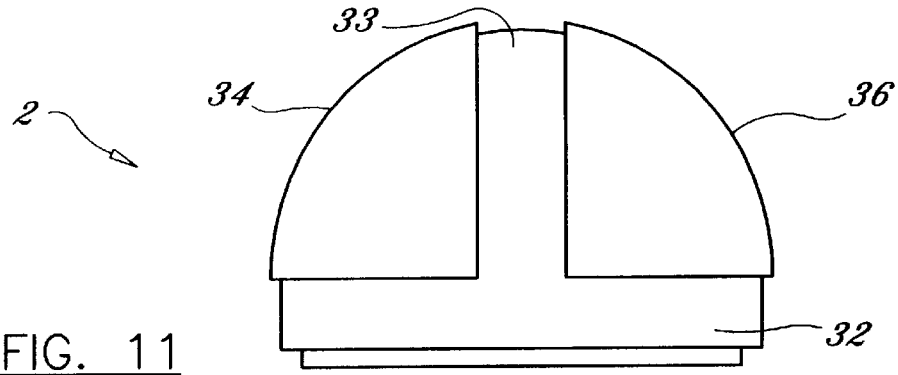
FIG. 11 is an end view of a novelty cap with openable areas having detachable flaps in a closed position in accordance with the present invention.
Figure 12:
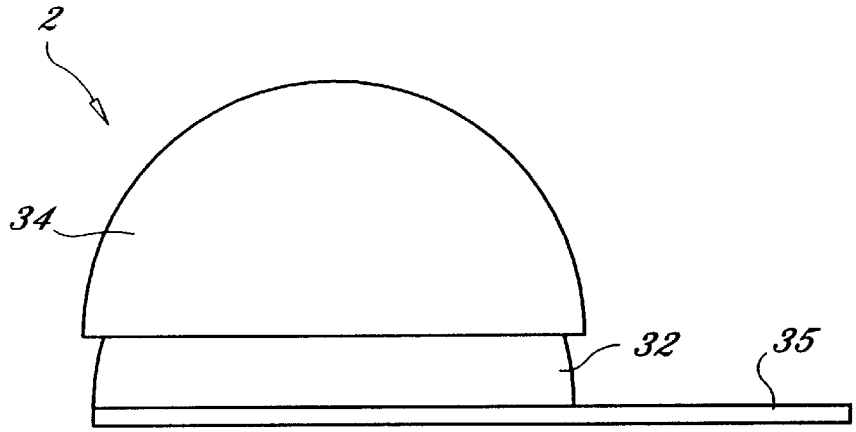
FIG. 12 is a side view of a novelty cap with openable areas having detachable flaps in a closed position in accordance with the present invention.
Figure 13:
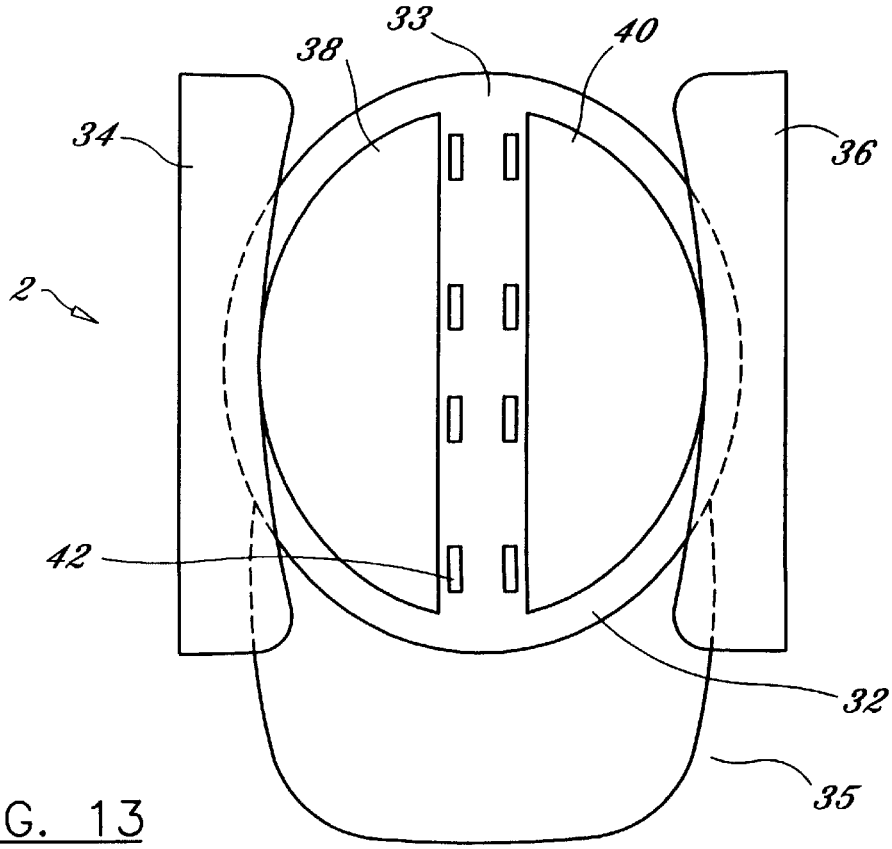
FIG. 13 is a top view of a novelty cap with openable areas having detachable flaps in a retracted position in accordance with the present invention.

FIGS. 10–14 show a novelty cap with openable areas 2. The novelty cap with openable areas 2 includes a cap body 32, a center flap support 33, a first detachable flap 34, and a second detachable flap 36. The center flap support 33 preferably extends from a front of the cap body 32 to a rear thereof. A visor 35 preferably extends outward from the cap body 32. With reference to FIGS. 10 and 11, a first opening 38 and a second opening 40 are formed between the cap body 32 and the center flap support 33. One end of the first detachable flap 34 is attached to a bottom side of the first opening 38 and one end of the second detachable flap 36 is attached to a bottom side of the second opening 40. Each detachable flap may be attached to a bottom side of each opening with adhesive, or any other suitable attachment device or method. The other end of the first detachable flap 34 is releasably attached to the center flap support 33 and the other end of the second detachable flap 36 is releasably attached to the center flap support 33. The detachable flaps may be attached to the center flap support 33 with hook and loop fasteners; snaps; or any other suitable releasable attachment device or method.

Figure 10A:
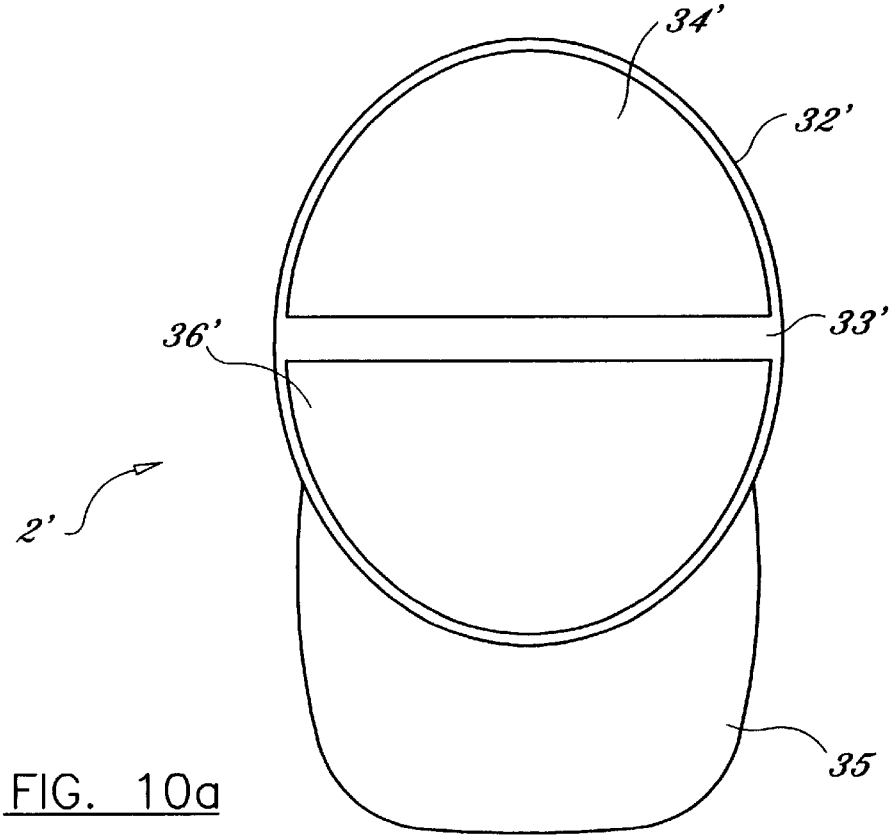
FIG. 10*a* is a top view of a novelty cap with openable areas having detachable flaps with the detachable flaps rotated substantially perpendicular to disclosed in figure 10*a* in accordance with the present invention.

With reference to FIG. 10*a*, a novelty cap having an openable area 2' includes a cap body 32', a center flap support 33', a first detachable flap 34', and a second detachable flap 36'. The detachable flaps have been rotated substantially perpendicular to those disclosed in FIG. 10. The construction of the novelty cap having an openable area 2' is the same as the novelty cap having an openable area 2. The only difference between the novelty cap 2 and the novelty cap 2' is the orientation of the detachable flaps relative to the wearer's forehead. The novelty cap having an openable area 2 or 2' should not be limited to orientating the detachable flaps relative to the wearer's forehead at only two different angles (as shown in FIGS. 10 & 10*a*, but should include any angle.

Hook and loop fasteners are commonly sold under the registered trademark, "Velcro." It is preferably to use hook and loop fasteners. A plurality of hook fasteners 42 are preferably attached to the center flap support 33. A plurality of loop fasteners 44 are preferably attached to the first and second detachable flaps. The plurality of hook fasteners 42 could also be attached to the first and second detachable flaps, and the plurality of loop fasteners 44 attached to the center flap support 33. When it is desirable to create an opening in the top of the novelty cap with openable areas 2, one or both of the detachable flaps are pulled back from a top of their respective openings.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A novelty cap with an openable area comprising:

a cap body having an opening in a top thereof;

a first pivot cover being pivotally attached to a top of said novelty cap;

a second pivot cover being pivotally attached to a top of said novelty cap; and a latching device holding said first pivot cover adjacent said second pivot cover, said pivot covers covering said open area of said cap body, said latching device being released to allow said pivot covers to reveal said opening.

2. The novelty cap with an openable area of claim 1, further comprising:

a visor extending from a bottom of said cap body.

3. The novelty cap with an openable area of claim 1, further comprising:

said first pivot cover being pivotally attached to said cap body with a first pair of rivets and said second pivot being pivotally attached to said cap body with a second pair of rivets.

4. The novelty cap with an openable area of claim 1, further comprising:

a slot being formed in one of said pivot covers, said latching device being attached to the other of said pivot covers, said latching device being depressed to allow said pivot covers to retract.

5. The novelty cap with an openable area of claim 1, further comprising:

a pop-up sign being attached to a front of said cap base, said pop-up sign rising to an upright position when said pivot covers are retracted.

* * * * *